US011669047B2

(12) United States Patent
Favre et al.

(10) Patent No.: US 11,669,047 B2
(45) Date of Patent: Jun. 6, 2023

(54) UNIVERSAL DEVICE FOR THE PREPARATION OF A WATCH

(71) Applicant: The Swatch Group Research and Development Ltd, Marin (CH)

(72) Inventors: Jerome Favre, Neuchatel (CH); Jean-Jacques Born, Morges (CH); Cedric Nicolas, Neuchatel (CH); Baptiste Hinaux, Lausanne (CH)

(73) Assignee: The Swatch Group Research and Development Ltd, Marin (CH)

( * ) Notice: Subject to any disclaimer, the term of this patent is extended or adjusted under 35 U.S.C. 154(b) by 849 days.

(21) Appl. No.: 16/499,735

(22) PCT Filed: May 21, 2019

(86) PCT No.: PCT/EP2019/063145
§ 371 (c)(1),
(2) Date: Sep. 30, 2019

(87) PCT Pub. No.: WO2019/224212
PCT Pub. Date: Nov. 28, 2019

(65) Prior Publication Data

US 2021/0011432 A1 Jan. 14, 2021

(30) Foreign Application Priority Data

May 21, 2018 (EP) ..... 18173402

(51) Int. Cl.
*G04B 5/00* (2006.01)
*G04B 3/00* (2006.01)
(Continued)

(52) U.S. Cl.
CPC ..... *G04B 5/00* (2013.01); *G04B 3/006* (2013.01); *G04B 18/021* (2013.01); *G04B 27/02* (2013.01);
(Continued)

(58) Field of Classification Search
CPC ..... G04B 3/006; G04B 5/00; G04B 18/021; G04B 27/02; G04C 1/04; G04D 7/004; G04D 7/1264
See application file for complete search history.

(56) References Cited

U.S. PATENT DOCUMENTS 9,292,000 B2 * 3/2016 Lamarche ..... G04B 7/00
2005/0254352 A1 * 11/2005 Wolf, V ..... G04D 7/009 368/206
(Continued)

FOREIGN PATENT DOCUMENTS

CH 699 301 A1 2/2010
CN 2773751 Y 4/2006
(Continued)

OTHER PUBLICATIONS

Japanese Office Action dated Nov. 10, 2020 in Japanese Patent Application No. 2019-552876 (with English translation), 5 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A universal device is for preparation of a watch with a gain/loss correction crown and an oscillating resonator. The device includes winding and a gain/loss corrector with a robotic manipulator for manoeuvring the crown. It also includes an adjustment device with a gain/loss correction device including a gain/loss-corrector oscillator generating an oscillation to subject the watch to an oscillation at a correction frequency NC and/or to a modulated movement. The gain/loss correction device includes a gain/loss controller that controls the oscillation of the gain/loss-corrector oscillator, interfaced with a device to measure the gain/loss of the watch. The gain/loss correction device also includes
(Continued)

an automatic winder with a watch-holder stand subjected to the oscillations or movements generated by the gain/loss-corrector oscillator.

14 Claims, 5 Drawing Sheets

(51) Int. Cl.

| | |
|---|---|
| ***G04B 18/02*** | (2006.01) |
| ***G04B 27/02*** | (2006.01) |
| ***G04C 1/04*** | (2006.01) |
| ***G04D 7/00*** | (2006.01) |
| ***G04D 7/12*** | (2006.01) |

(52) U.S. Cl.
CPC ..... *G04C 1/04* (2013.01); *G04D 7/004* (2013.01); *G04D 7/1264* (2013.01)

(56) References Cited

U.S. PATENT DOCUMENTS

| | | | | |
|---|---|---|---|---|
| 2014/0003200 | A1 | 1/2014 | Lamarche | |
| 2018/0341225 | A1* | 11/2018 | Favre | A44C 5/0007 |
| 2018/0341226 | A1* | 11/2018 | Favre | G04B 18/021 |

FOREIGN PATENT DOCUMENTS

| | | | |
|---|---|---|---|
| CN | 101495923 | A | 7/2009 |
| CN | 102135753 | A | 7/2011 |
| CN | 105103058 | A | 11/2015 |
| CN | 204989769 | U | 1/2016 |
| CN | 106940520 | A | 7/2017 |
| CN | 107077096 | A | 8/2017 |
| DE | 10 2006 032 124 | A1 | 1/2010 |
| DE | 10 2008 032 124 | A1 | 1/2010 |
| DE | 10 2013 012 854 | B3 | 5/2014 |
| EP | 3 410 235 | A1 | 12/2018 |
| EP | 3 410 236 | A1 | 12/2018 |
| EP | 3 537 233 | A1 | 9/2019 |
| WO | WO 2012/126978 | A1 | 9/2012 |

OTHER PUBLICATIONS

Combined Chinese Office Action and Search Report dated Nov. 4, 2020 in Chinese Patent Application No. 201980002212.4 (with English translation), 10 pages.

International Search Report and Written Opinion dated Aug. 29, 2019 in PCT/EP2019/063145 filed May 21, 2019 (with English translation of categories of cited documents).

* cited by examiner

UNIVERSAL DEVICE FOR THE PREPARATION OF A WATCH

CROSS-REFERENCE TO RELATED APPLICATIONS

The present application is a national stage entry of International Application No. PCT/EP2019/063145, filed May 21, 2019, which claims priority to European Patent Application No. 18173402.1, filed on May 21, 2018, the entire content and disclosure of which are incorporated by reference herein.

FIELD OF THE INVENTION

The invention concerns a universal device for preparing a watch including a first crown for correction of gain/loss in time and an oscillating resonator arranged to generate an oscillation at a nominal frequency, said universal preparation device comprising means for winding and for correcting the gain/loss in time of said watch, comprising at least one robotic manipulator for operating said first crown.

The invention also concerns a storage arrangement for a watch bank comprising such a universal preparation device and at least one said watch comprising a time base including at least one oscillating resonator, means of gain/loss correction via a control stem provided with a said first crown, and energy storage means or a barrel, and energy charging means. The invention also concerns a method for adjusting the gain/loss in time of a watch.

The invention concerns the field of watch maintenance and devices for quickly providing the user with a watch from his collection, which has an updated gain/loss adjustment, a satisfactory rate adjustment and is fully charged with energy.

BACKGROUND OF THE INVENTION

Current winder mechanisms use conventional gearing between an electric motor and a watch-holder. This type of transmission is sufficient for continuous rotation, in economical, low-cost, low-power manufacturing. However, if such a winder mechanism is used for relatively fast back-and-forth motions, in particular an oscillatory motion, which consists in subjecting the watch to vibrations, by moving it around with a modulated movement of adjustment, especially a periodic motion, up to a frequency of 10 Hz or more, impact noises may appear and disturb the user.

The oscillatory motion method is described in Swiss Patents CH713821 and CH713822 by the same Applicant and is very advantageous for the correction of small variations in rate. However, it cannot yet correct, in less than one day, a gain/loss error of more than plus or minus one minute.

Finally, if the minute hand and the seconds hand are not properly indexed with respect to each other, the information can currently be passed on to the client, but the indexing cannot be corrected.

German Patent No. DE10 2008 031124 in the name of GEHRING BERND discloses a device for positioning a watch display, which includes externally controlled means for the adjustment of data and functions, wherein several control units comprise mechanical adjustment units able to act in rotation and/or compression/traction on a watch crown or pusher.

WO Patent Application No. 2012/126978A1 in the name of IMH discloses a multi-function case adaptable for the winding of an automatic or manual watch having one or more displays, wherein the case includes: a box including a removable support arranged for receiving the watch; a winder mechanism is intended to wind the watch when the latter is placed on the removable support. The multi-function case further includes an adjustment mechanism adapted for the adjustment of one or more displays, such that the watch keeps time when placed inside the case. In particular, the device can include a camera for capturing a display position, and image analysis means and means for comparison to a reference.

German Patent No. DE102013012854B3 in the name of GODER REINHARD discloses a device for correcting deterioration in the rate of a watch, or at the very least means for maintaining the rate at a constant value when it is not being worn. Different means of capture, such as a camera with image analysis, laser sensor, microphone, can be connected to a central unit, which receives a reference clock signal, and which controls a mechanism for automatically moving the watch.

SUMMARY OF THE INVENTION

The invention proposes to very quickly correct gain/loss errors of more than one minute, particularly for the change of summer/winter time, a different time zone change, or for correcting the date.

To this end, the invention concerns a universal device for preparing a watch according to claim 1.

The invention also concerns a storage arrangement for a watch according to claim 9.

The invention also concerns a method for adjusting the gain/loss of a watch according to claim 14.

BRIEF DESCRIPTION OF THE DRAWINGS

Other features and advantages of the invention will appear upon reading the following detailed description, with reference to the annexed drawings, in which:

FIGS. 4 to 7 illustrate the steps of a method for adjusting the gain/loss of a watch, with another part of the universal preparation device, which includes a robotic manipulator and in which:

in FIG. 4, there is shown a first removable cap adapted to a first crown of the watch;

in FIG. 5 this first crown is pulled out;

in FIG. 6, the first crown is fitted with this first removable cap;

in FIG. 7 the watch is placed on a stand;

DETAILED DESCRIPTION OF PREFERRED EMBODIMENTS

Swiss Patent Nos. CH00698/17 and CH00699/17 by the same Applicant disclose a smart winder mechanism capable of controlling the frequency of at least one mechanical watch. Various embodiments were envisaged, in particular, variants controlling several watches on the same device, which is a recurring demand from watch lovers and collectors.

Naturally, everything that is described here for a watch, specifically intended for implementation of the invention at a user's home, is applicable to an uncased movement, in the factory or in after-sales service. The term 'watch' is thus used for the sake of simplicity, both for a complete watch and simply for its movement.

The invention proposes to improve such a mechanism, with the development of a universal preparation device 1000, which includes a smart winder with the following functions:

precisely controlling the frequency of several mechanical watches having at least one oscillating resonator. The device has access to a reference time base. The stand incorporated in the winder imparts an oscillatory motion to each watch, which imposes a reference frequency on the watch balance spring;

using a winder, non-restrictively, with a backlash take-up gear to minimise noise during the oscillatory phases;

correcting large gain/loss errors by reading the time optically and then manipulating the crown.

Figure 1:
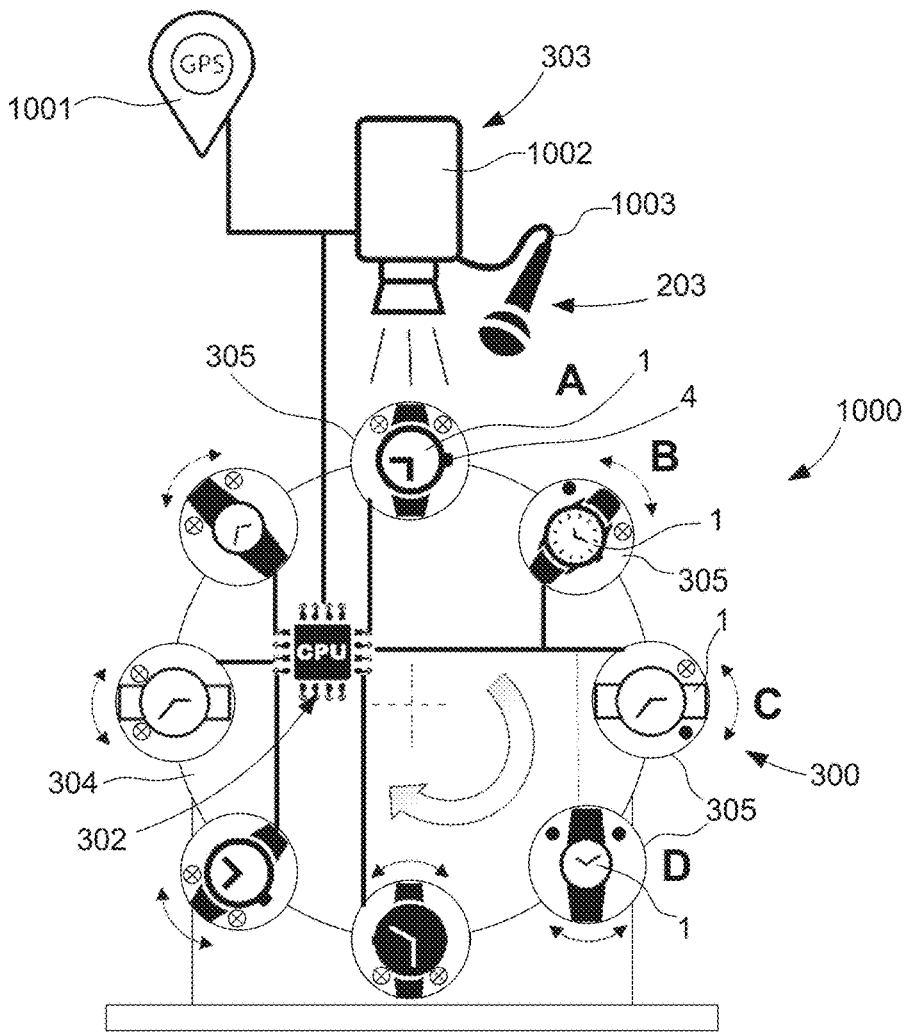
FIG. 1 represents a schematic, front view of one part of a universal preparation device according to the invention, which includes a winder mechanism which carries several different watches mounted on the same device, each on a stand capable of at least one oscillatory motion, especially a pivoting motion: this winder includes gain/loss measuring means with a fixed vision system for evaluating the gain/loss of each watch, and capable of comparing the time read to a reference clock, illustrated here by a GPS link; this winder further includes a microphone for evaluating the frequency and rate of the watch; this winder is a rotary winder, successively moving each watch in front of the vision system and the microphone—there is only one of each in this particular embodiment.

FIG. 1 illustrates a winder 304 with several different watches mounted on the same device. These watches 1 must, however, all have the following characteristics: their time base must be an oscillating resonator, and they must have an oscillating weight allowing (one or two-directional) automatic winding. This winder 304 of FIG. 1 includes a rotary drum, which carries stands 305 for receiving watches. All the watches must be mounted on the winder in a vertical or substantially vertical position, i.e. the movement plane passes through the direction of the local gravitational field, or the smallest angle between the movement plane and the direction of the local gravitational field is less than 45°. Positioning with a slight tilt may be advantageous for the purposes of display, for example to exhibit watch collections in a shop window, museum or otherwise, improving visibility for the spectator, especially when he is positioned higher than the winder. Advantageously, such a winder can carry several watches, for example eight in the case of FIGS. 1 and 2, and particularly up to around a dozen watches, which still makes it possible for the winder to have reasonable dimensions, and it can be placed on a piece of furniture and is easy to move.

Watches 1 may, however, have different displays (provided there is a dial and hands, or an analogue dial using a disc, roller or suchlike, which can be read and interpreted by an optical means) and any oscillator—especially balance spring—frequency, in practice with a maximum value of 20 Hz. The barrel may be in any state of wind when mounted on the device. The watch can theoretically have any time setting, although, in practice, a pre-setting of ±1 minute is recommended.

Each watch passes in succession in front of a fixed vision system 303 (camera 1003+lighting+CPU 302) to evaluate its gain/loss, by reading the time and comparing it to a reference clock (symbolised by reference 1001), non-restrictively, by a GPS link).

Just as in Swiss Patent Nos. CH00698/17 and CH00699/17 by the same Applicant, it is possible for at least one watch-holder stand 305, and more particularly each watch-holder stand 305, to have a microphone 1003 for evaluating the frequency, rate and amplitude of the balance spring (the amplitude measurement—although approximate—makes it possible to evaluate the state of wind of the barrel). FIG. 1 illustrates a variant with a single fixed microphone 1003, for making these measurements, when watch 1 reaches the right position.

In a variant, at least one stand 305 is autonomous and incorporates an energy supply means 308, such as a cell or battery, one such microphone 1003, and a transmitter 307, notably with an antenna for transmission to a centralised control means. If this stand does not have its own on board smart system, it is arranged to transmit a signal by means of the centralised control means.

In another variant, at least one stand 305 is autonomous, and incorporates an energy supply means 308, such as a cell or battery, a processor 309 (CPU), and a transmitter 307, notably with an antenna for transmission to a centralised control unit. Since this stand has its own on board smart system, it is able to process the signal and is arranged to then transmit the result of its local processing to the centralised control means.

As will be seen below, in one or other of these variants, at least one such stand 305 may include at least one gain/loss-corrector oscillator 301 for correcting the gain/loss of the watch mounted on stand 305 and/or a master oscillator 201 for correcting the rate of this watch.

Or, one such stand 305 may be entirely subjected to the action of at least one gain/loss-corrector oscillator 301 for correcting the gain/loss of the watch mounted on stand 305, and/or a master oscillator for correcting the rate of this watch.

A microphone 1003 may be a contact microphone or an aerial microphone.

In an advantageous variant, contactless transmission is used between each microphone 1003 and the control centre, which here includes gain/loss control means 302. This contactless transmission facilitates the design of rotating mechanisms like that of FIG. 1, the microphone(s) 1003 can be mounted on the drum which carries watch-holder stands 305, and communicate with a fixed CPU 302, or, conversely, microphone(s) 1003 can be fixed and communicate with a CPU 302 mounted on the drum that carries watch-holder stands 305.

When the frequency, gain/loss and amplitude of each watch are known, it is then possible, as a result of the invention, to wind the watch if necessary, in an optimum manner without stressing the mechanism or the barrel drum, and to correct its gain/loss (to some extent, typically ±30 seconds in one night).

Figure 2:
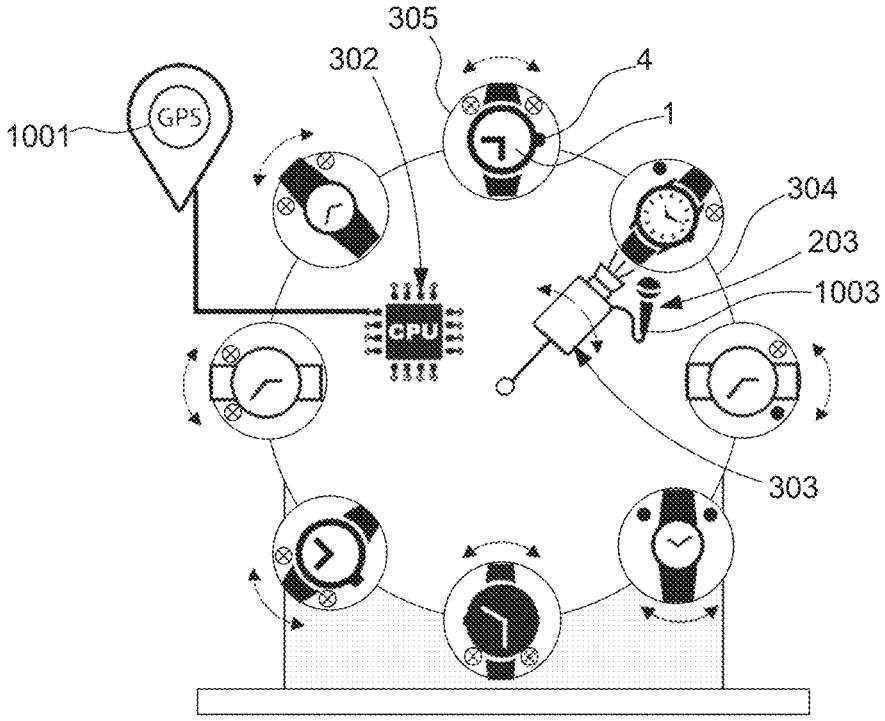
FIG. 2 represents, in a similar manner to FIG. 1, a winder wherein the vision system and microphone are movable, and the stands are in a fixed position.
Figure 3:
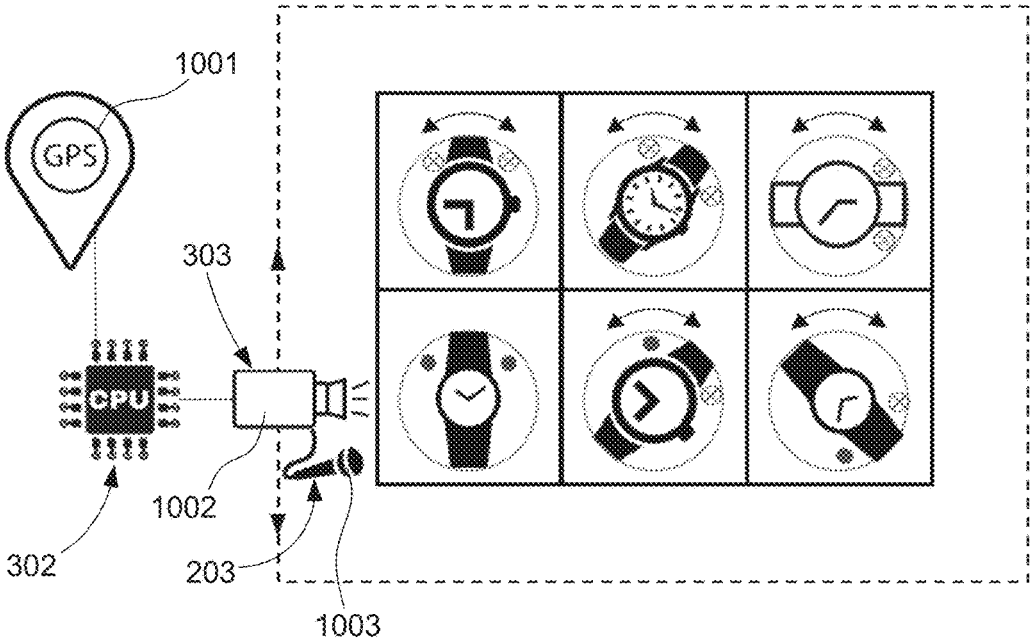
FIG. 3 represents, in a similar manner to FIG. 2, another winder wherein the vision system and microphone are movable and wherein the stands are in a fixed position.

FIG. 2 illustrates a variant in which winder 304 does not necessarily have a rotating drum and includes a fixed structure that carries watch-receiving stands 305. Fixed vision system 303 and microphone 1003 are movable and move towards the various stands. FIG. 3 represents another winder whose vision system and microphone are movable, and in which the stands are in a fixed position and grouped in rows, a manipulator (not represented), and which carries the vision system and the microphone, is then movable according to Cartesian coordinates. Many other geometric and kinematic arrangements are possible and are limited only by the size and total mass of the universal preparation device according to the invention.

Naturally, it is also possible to combine the embodiments of FIGS. 1 and 2 with a rotating drum carrying the stands and with the fixed vision system 303 and microphone 1002 which are movable and move to the various stands.

In a preferred construction, each watch-holder stand 305 has a motor or a cam or gear system that makes it possible:

either to move watch 1 in order to adjust it while also winding it through rotation of the whole stand, by the movement of oscillating weight 7 of watch 1 when the watch includes such a weight (a movement that can be clockwise or anticlockwise);

or to vibrate watch 1 by moving it in a modulated movement for adjustment without winding, by compensating for the winding movement caused by the whole stand (in order to avoid overwinding a watch that is completely wound, which would cause premature wear of the barrel drum).

In a particularly advantageous variant of the invention, the watch is vibrated in the direction of the degree of freedom of its oscillator, when there is only one degree of freedom.

The four examples below illustrate different possible cases:

a watch A was measured to have an amplitude of 200° and must therefore be wound. It was measured to have a gain of 20 seconds and a basic frequency of 4 Hz, and must therefore be vibrated at a frequency of less than 4 Hz (typically 3.9986 Hz, i.e. minus 30 seconds per day) to slow it down until its gain is brought to 0 seconds (in this example, this will take 16 hours);

a watch B was measured to have an amplitude of 250° and it therefore must be wound a little more. It was measured to have a gain/loss of 0 seconds and a base frequency of 3.5 Hz, and must therefore be vibrated at a frequency equal to 3.5 Hz to maintain its gain/loss at 0 seconds;

a watch C was measured to have an amplitude of 300° and is considered to be wound to maximum capacity. Its orientation is thus kept constant. It was measured to have a loss of 5 seconds and a basic frequency of 3.5 Hz, and must therefore be vibrated at a frequency higher than 3.5 Hz (typically 3.5012 Hz, i.e. plus 30 seconds per day) to accelerate it until its loss is brought to 0 seconds (in this example, this will take 4 hours);

a watch D was measured to have an amplitude of 300° and is thus considered to be wound to maximum capacity. Its orientation is thus kept constant. It was measured to have a gain/loss of 0 seconds and a base frequency of 3 Hz and must therefore be vibrated at a frequency equal to 3 Hz to maintain its gain/loss at 0. Indicators (2 green LEDs in the example of FIG. 1 or 2—one to specify the state of wind and the other to specify the gain/loss adjustment) make it possible to quickly identify this watch which is then ready to be worn.

FIGS. 2 and 3 illustrate two embodiments wherein vision system 303 is movable and watch-holder stands 305 are fixed in position relative to the winder assembly, and each movable, particularly pivotable.

The invention proposes in a non-limiting manner to use a backlash take-up gear, a chevron gear or a direct drive. These solutions minimise the noise generated by the back-and-forth motions inherent to the watch vibration principle.

It is known to correct large gain/loss errors by acting on the crown to pivot the gain/loss correction stem, notably to change the time display.

Thus, the invention more particularly concerns a universal device 1000 for preparing a watch 1. This watch 1 includes a first gain/loss correction crown 4 and an oscillating resonator 2, which is arranged to generate an oscillation at a nominal frequency N0. This universal preparation device 1000 comprises means for winding and for correcting the gain/loss of watch 1, and it comprises at least one robotic manipulator 306 for operating first crown 4.

According to the invention, this universal preparation device 1000 includes an adjustment device, which includes at least one gain/loss correction device 300 for correcting the gain/loss of watch 1. This gain/loss correction device 300 includes a gain/loss-corrector oscillator 301 which is arranged to generate an oscillation at a correction frequency NC, and to subject watch 1 to an oscillation at correction frequency NC and/or to a modulated movement.

This gain/loss correction device 300 comprises gain/loss control means 302, which are arranged to control the oscillation of gain/loss-corrector oscillator 301, and which are interfaced with means 303 for measuring the gain/loss of watch 1.

This gain/loss correction device 300 includes an automatic winder 304 for manual or automatic mechanical watches, and includes at least one watch-holder stand 305, which is subjected to oscillations and/or movements generated by gain/loss-corrector oscillator 301.

More particularly, gain/loss control means 302 are also arranged to adjust the rate of the watch. To this end, they are also arranged to control an excitation oscillation generated by a master oscillator 201 at an excitation frequency NE, approximately equal to nominal frequency N0 of watch 1, or to a multiple integer of the latter, with a master variation-in-rate value AM compared to a reference 202, which is lower than the initial variation-in-rate value D1 of watch 1. These gain/loss control means 302 are then interfaced with rate measuring means 203 to measure the variation in rate of watch 1.

More particularly, the same oscillator forms both gain/loss-corrector oscillator 301 and master oscillator 201.

Figure 13:
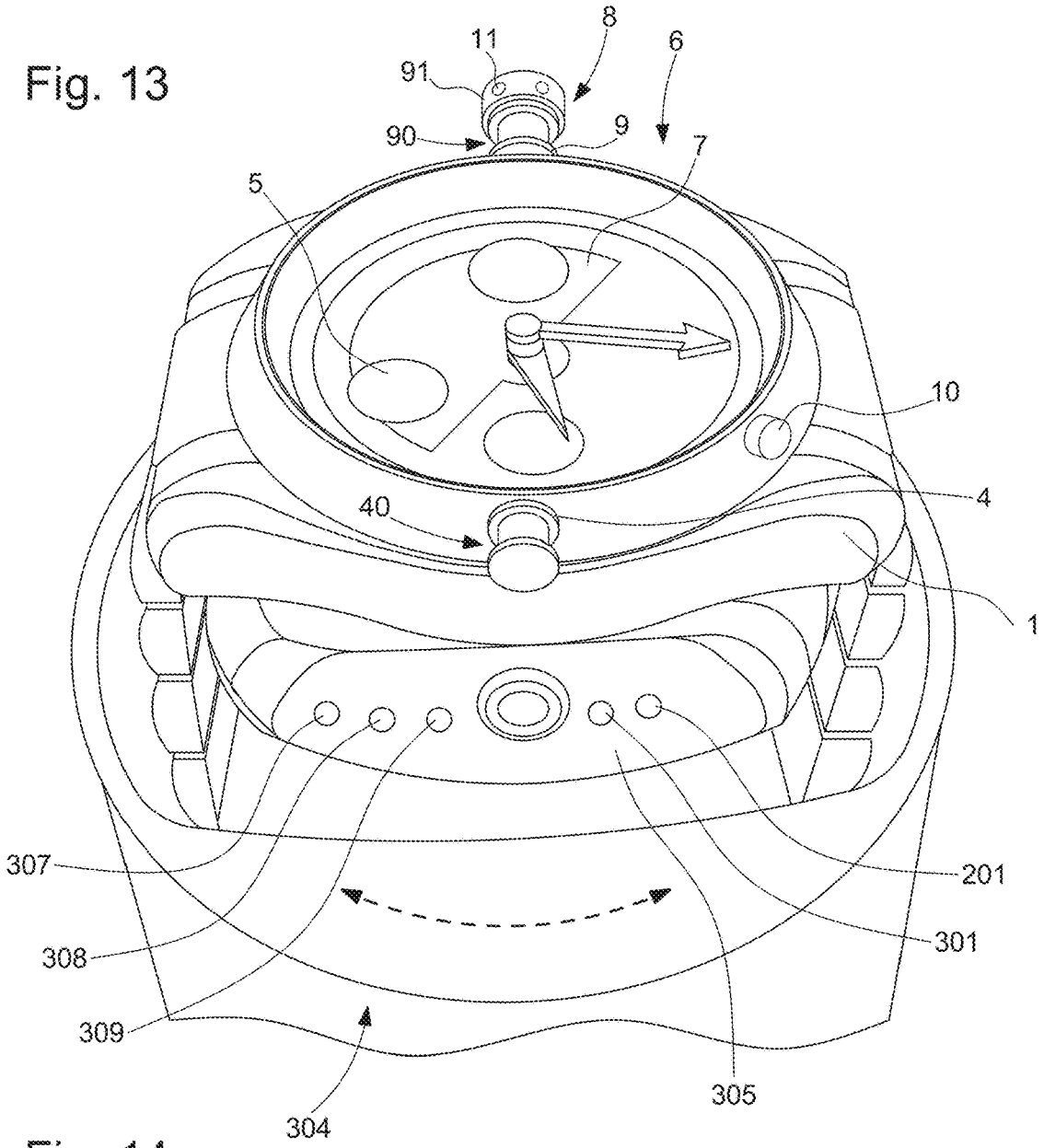
FIG. 13 represents a partial schematic perspective view of a watch secured to a stand, which includes a barrel and an automatic winding weight, a first gain/loss-corrector crown including a manipulation groove, a second winding crown including a manipulation groove and equipped here with a second removable cap arranged to grip and grip said crown to allow manipulation by a robotic manipulator, and an actuator also able to be manipulated by a motorized manipulator.
Figure 14:
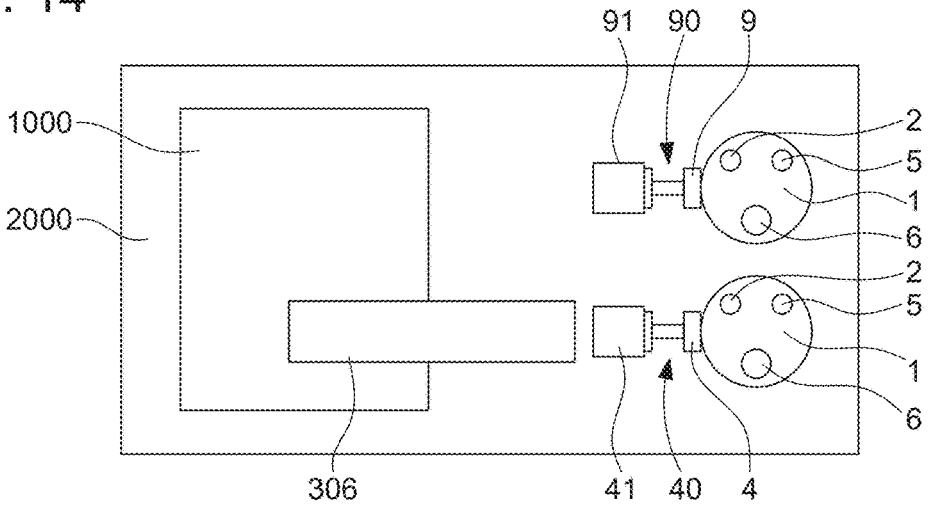
FIG. 14 represents a block diagram of a storage arrangement for a watch bank, which includes such a universal preparation device, and watches each containing a time base with an oscillating resonator, means of gain/loss correction via a control stem provided with a first crown, energy storage means or a barrel, energy charging means, notably arranged entirely or partly like the watch represented in FIG. 13.

State-corrector oscillator 301 and/or master oscillator 201 is a higher precision oscillator than those of ordinary commercial watches, such as a regulator oscillator or a quartz oscillator, and is less expensive and more compact and consequently easy to incorporate in a stand 305 like that represented in FIG. 13.

In a variant, automatic winder 304 for automatic or mechanical watches is motorized and able to automatically wind an automatic watch by moving watch 1 and its oscillating weight 7 and/or by the magnetic driving of its oscillating weight 7.

In particular, this automatic winder 304 is able to produce a vibration of at least one magnet, in particular for the magnetic driving of an oscillating weight 7.

One improvement consists in the use of a cap, manually added by the user to the crown, or positioned on this crown by a robotic manipulator. The user or manipulator can also place the stem in the gain/loss correction position. Such a cap greatly facilitates the automated correction phase. Indeed, ordinary operations for handling a watch stem require some gentleness, which is difficult to automate, whereas a cap with a standard exterior is relatively simple for the device to handle, with no risk of scratching or breakage. Preferably, in order to adapt to a maximum number of crowns, various caps are available to the user, who can thus select the most suitable one.

In a variant, an automatic vision system is used, which is arranged to identify the shape and dimensions of the crown, and which is interfaced with a control system to determine, in a cap bank of caps 410, the most suitable cap for the crown concerned. A robotic manipulator can thus, after (manual or automatic) assembly of this cap on the crown, very easily be coupled to or engaged with the cap, and thus indirectly operate the crown and the stem. In another variant, it is possible to use a movable disc coated with a suitable material, such as, for example, rubber of suitable hardness, placed in contact with the crown by optical force sensors, and then drive the crown in rotation in one direction or the other. This variant has the advantage of being intrinsically adaptable to a crown of any shape or dimensions.

This allows implementation of a mode of use wherein the watch is only wound, and its gain/loss is only corrected when the user or client so requests: indeed, winding using the stem can be performed in a few minutes, as can the gain/loss correction. Correction by the crown can also precisely index the minute hand with the seconds hand.

Figure 4:
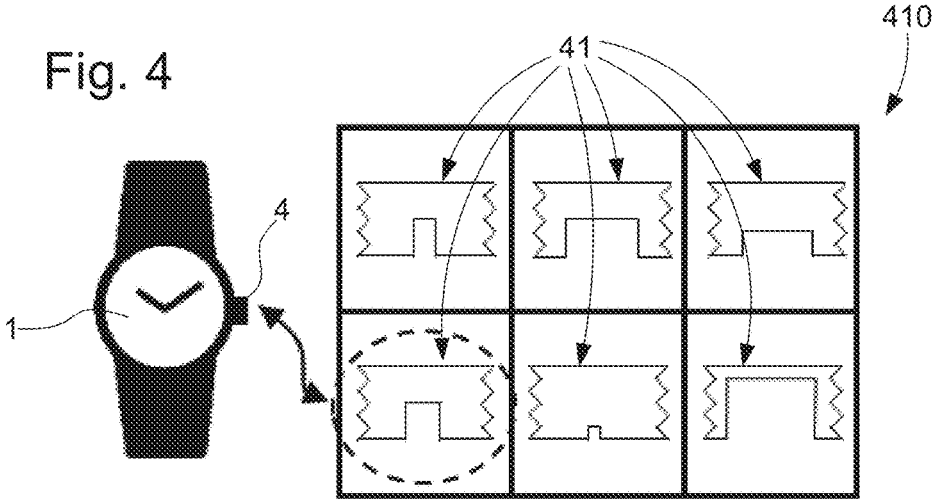
Figure 5:
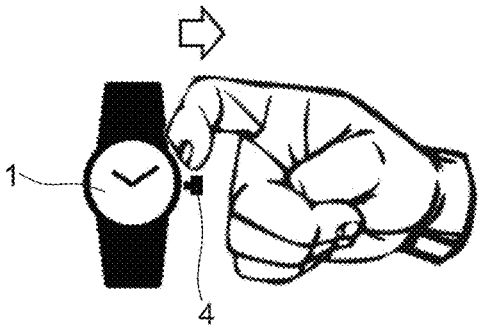
Figure 6:
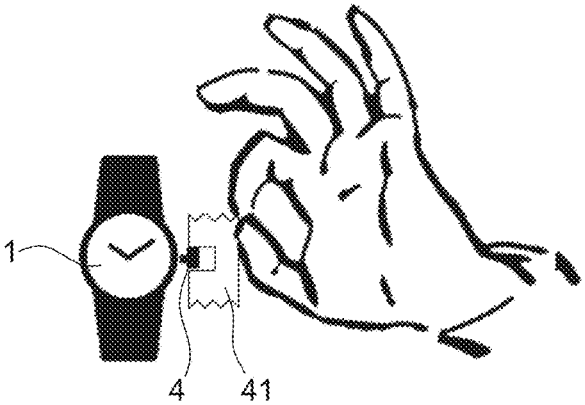
Figure 7:
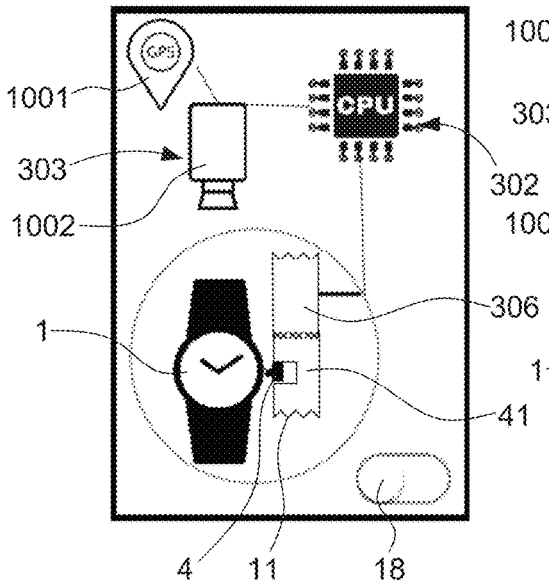
Figure 8:
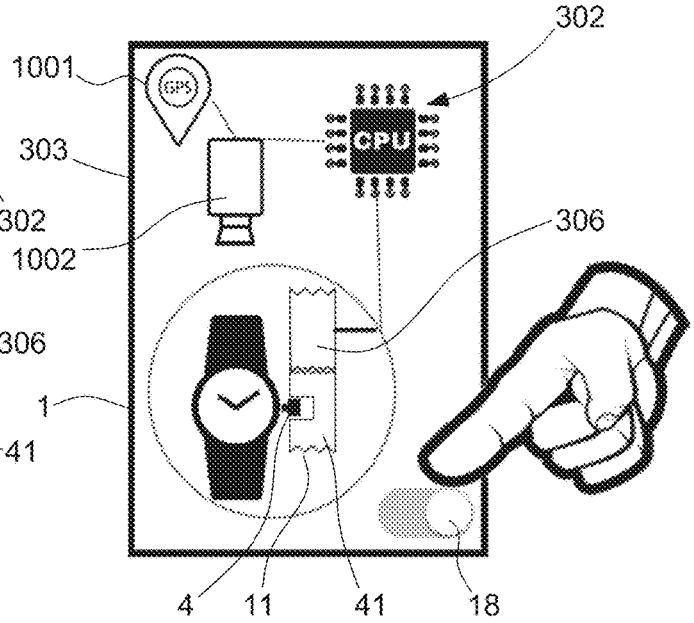
in FIG. 8 an action is performed on a control means in order to activate the gain/loss measuring means and measure the gain/loss of the watch.
Figure 9:
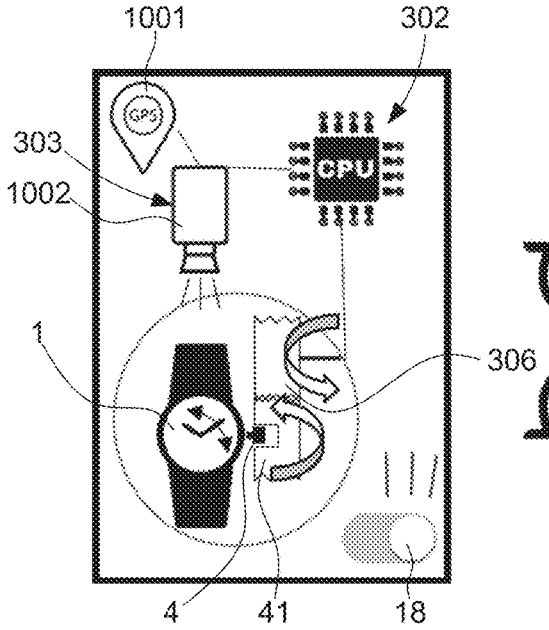
in FIG. 9, the gain/loss of the watch is adjusted by a robotic manipulator which is controlled by said gain/loss control means and which manipulates this first removable cap.
Figure 10:
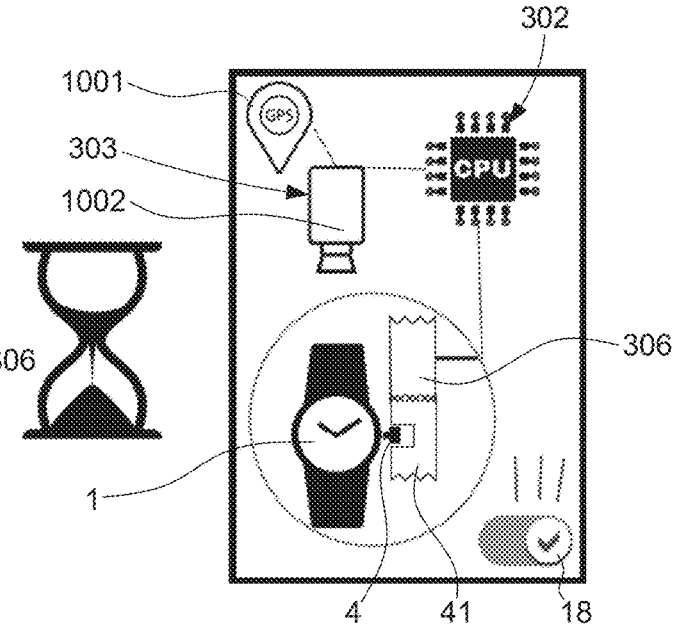
in FIG. 10, after some time, the user is informed, optionally, of the completion of the gain/loss adjustment of his watch by a signal from the control means.
Figure 11:
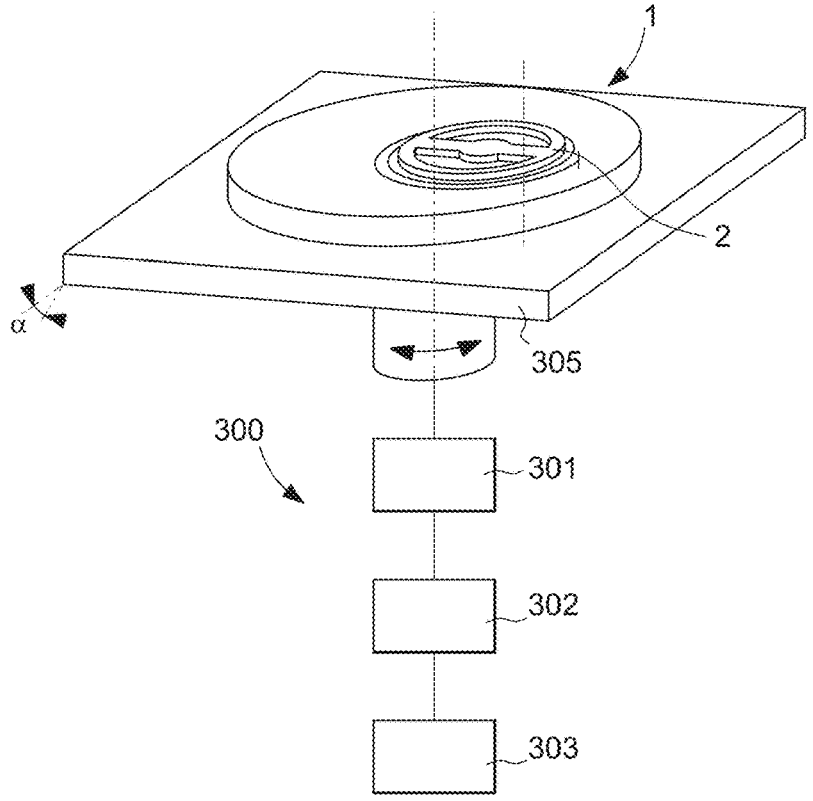
FIG. 11 is a partial schematic perspective view of the oscillator of a watch held on a stand, subjected to the action of a gain/loss correction device which comprises gain/loss control means for controlling a gain/loss-corrector oscillator arranged to generate an oscillation at a correction frequency, and to subject the watch to an oscillation at this correction frequency and/or to a modulated movement, the gain/loss correction device comprising gain/loss control means, arranged to control the oscillation of the gain/loss-corrector oscillator and interfaced with gain/loss measuring means for measuring the gain/loss of the watch.
Figure 12:
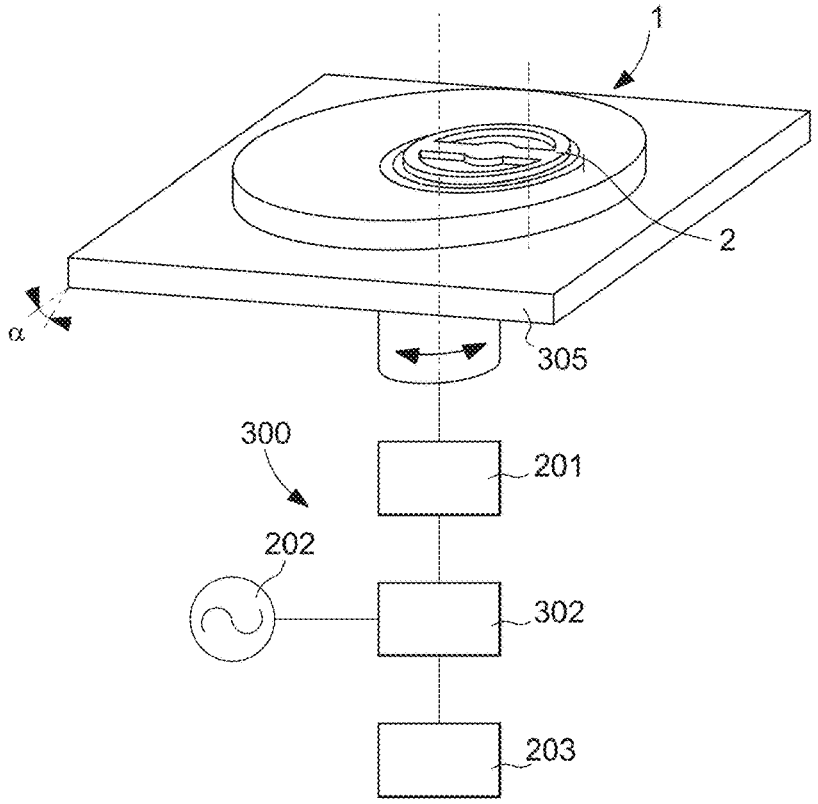
FIG. 12 represents a partial schematic perspective view of the watch oscillator of FIG. 11, wherein the gain/loss control means are also arranged to control an excitation oscillation generated by a master oscillator at an excitation frequency, approximately equal to the nominal frequency of the watch oscillator, or to a multiple integer of the latter, and which are interfaced with rate measuring means to measure the variation in rate of the watch.

FIGS. 4 to 10 illustrate a proposed algorithm:

FIG. 4: the cap 41 of an array of caps 410 which is most suitable for crown 4 of the watch 1 to be adjusted, is identified;

FIG. 5: the stem is pulled out, for example manually, by crown 4;

FIG. 6: cap 41 is placed on crown 4;

FIG. 7: watch 1 is placed in the device (on standby), which includes a robotic manipulator 306 which engages with cap 41;

FIG. 8: when the client wishes to wear his watch, he performs an action on a control means 18 to activate the gain/loss measuring means 303 and measure the gain/loss of watch 1, the device is then activated;

FIG. 9: the gain/loss of watch 1 is adjusted by robotic manipulator 306, controlled by gain/loss control means 302; the gain/loss correction and winding operations are performed in succession by the stem. The hands are compared to a reference for an exact gain/loss correction and for perfect indexing between the minute and seconds hands;

FIG. 10: after a few minutes, the watch is wound and set to time. An indicator, on control means 18 here, indicates that the watch is ready to be worn.

It is clear that the gain/loss adjustment and winding device visible in FIGS. 7 to 10 can be used alone.

In a variant, this gain/loss adjustment and winding device is combined with universal preparation device 100, watch 1, taken from a storage arrangement for a watch bank 2000, is then placed on one of stands 305, on which robotic manipulator 306 can act. For example, robotic manipulator 306 can be arranged substantially radially with respect to the rotating drum of the automatic winder of FIG. 1, stands 305 then have a particular indexing position in order to present the watch stem in a particular orientation in space, and to present the crown, either outside the drum if robotic manipulator 306 is arranged on the outside of this drum, or towards the centre of the drum if robotic manipulator 306 is arranged inside the drum, between the stands.

Thus, in an advantageous embodiment, at least one robotic manipulator 306, and more particularly each robotic manipulator 306, is arranged to manoeuvre a first removable cap 41 tightly gripping first crown 4, or to grip a peripheral groove 40 comprised in first crown 4.

In particular, automatic winder 304 includes at least one such robotic manipulator 306 capable of winding, i.e. charging energy storage means 5, comprised in watch 1, by manoeuvring first crown 4, or a second crown 9 specifically for winding, or a removable cap 41 tightly gripping said first crown 4, or a second removable crown 91 tightly gripping second crown 9, as seen in the watch of FIG. 13.

Advantageously, universal preparation device 1000 includes a reference clock 1001, or is interfaced with such a reference clock 1001, to which gain/loss measuring means 303, which include a vision system 1002, refers. Thus, if the gain/loss relative to clock reference 1001 is less than one minute, gain/loss control means 302 are arranged to generate at least one oscillation of gain/loss-corrector oscillator 301 to return the gain/loss of the watch to the value of reference clock 1001, or, if the gain/loss relative to the reference clock is more than one minute, to cause a robotic manipulator 306 to operate first crown 4 to adjust the gain/loss of watch 1.

In an advantageous variant with rate correction, rate measuring means 203 include at least one microphone 1003 for evaluating the frequency, rate and amplitude of oscillating resonator 2 of watch 1. And, if a variation in rate greater than a predetermined threshold is observed, gain/loss control means 302 are arranged to generate at least one excitation oscillation by means of a master oscillator 201 at excitation frequency NE to return the variation in rate to the value desired by the user, and more particularly, but not limited to an intermediate value between master value AM and initial value DI of the variation in rate of watch 1.

The invention advantageously applies to a storage arrangement for a watch bank 2000, which may be a user's collection, or the stock of a retail outlet, or otherwise.

Such a storage arrangement for a watch bank 2000 advantageously includes one such universal preparation device 1000 described above, and at least one watch 1 including a time base having at least one oscillating resonator 2, means of gain/loss correction via a control stem provided with a first crown 4, energy storage means 5 or a barrel, energy charging means 6. More particularly but not exclusively, these energy charging means 6 are formed by an automatic winding mechanism including at least one oscillating weight 7 and/or formed by a manual winding mechanism using the control stem or by a winding mechanism 8 comprising a second crown 9 or a pusher. In a particular variant, energy charging means 6 are formed by an automatic winding mechanism including at least one wheel set inside the case of watch 1 and arranged to be driven contactlessly by contactless drive means comprised in automatic winder 304 or stand 305, or by a magnetic or electrostatic field.

Each watch 1 of this storage arrangement for a watch bank 2000 advantageously includes, for automatic adjustment of the gain/loss thereof, a first groove 40 around first crown 4 and/or a first removable cap 41 arranged to tightly grip first crown 4 to allow the manipulation thereof in translation and/or rotation by a robotic manipulator 306.

More particularly, in such a storage arrangement for a watch bank 2000, at least one watch 1 includes, for the automatic energy charging thereof, a second groove 90 around said second crown 9 and/or a second removable cap 91 arranged to tightly grip second crown 9 to allow the manipulation thereof in translation and/or rotation by a robotic manipulator 306. One variant consists of a driver, disc, ring or suchlike, coated with a suitable material such as rubber, suitable for friction driving, and placed in contact with the winding crown in order to rotate the latter.

Advantageously, at least one watch 1 of this storage arrangement for a watch bank 2000 includes a removable cap 41, 91, for watches, whose internal profile is complementary to the external profile of a crown 4, 9 or of an actuator 10 (pusher or pull-piece, or the like) comprised in watch 1, said removable cap 41, 91 is articulated and/or elastically deformable between a first presentation position in which removable cap 41, 91 can be radially or frontally inserted onto a crown 4, 9 or an actuator 10, and a second clamping position in which removable cap 41, 91 is able to grip crown 4, 9 or actuator 10 tightly longitudinally or radially. And this removable cap 41, 91 includes external gripping means 11 which, in its second clamping position, are arranged to allow manipulation by a robotic manipulator 306 in all degrees of freedom. Such a removable cap also forms a means of protecting the crown when the watch is not being used, and its simplicity makes it cost particularly low, the user can thus advantageously systematically place a cap on a crown when he changes watches.

The invention makes it possible to manage a watch collection with two levels of intervention: firstly by correcting large gain/loss variation by the action of a robotic manipulator on the crown of the watch, and secondly by maintaining and finely adjusting the watches on a winder, especially multiple watches, carrying stands equipped with gain/loss-corrector oscillators and, advantageously, rate-corrector oscillators, which may be the same as the preceding oscillators.

Naturally, both the robotic manipulator and the automatic winder equipped with rate and/or gain/loss-corrector oscillators, are each capable of performing the first and second levels of correction, but combining the two provides the advantage of not unduly implementing one or the other of these devices for one particular watch or another.

To this end, gain/loss control means 302 of this universal preparation device are also arranged to manage the duration of occupation of each stand 305 by each watch 1 of a storage arrangement for a watch bank 2000, and advantageously include an interface with a computer-aided production management system for managing a schedule for moving the various watches 1 on the various stands 305, which is particularly advantageous in the context of preparing watches prior to shipment in a factory or in an after-sales service, or in a major sales outlet.

These control means preferably perform self-diagnosis, to suggest dispatch to after-sales service if necessary, for example to reset the gain/loss or to correct the maximum oscillation amplitude, or otherwise. This suggestion or warning is simple to achieve by a display on a set of LEDs or suchlike.

In a particular variant, these control means are arranged to be connected to a GPS or similar signal, particularly to determine the terrestrial position of the watch and the local time zone.

In this latter case of the sales outlet, universal preparation device 1000 provides the advantage of very great versatility, since it is not dependent on watch manufacturers, who may have different displays and oscillators set to different frequencies.

The private collector therefore also has a single device, which allows him to maintain a very diverse collection, in the best possible state of availability and in the best possible state of precision, and at a low cost in comparison to his investment in timepieces.

The invention claimed is:

1. A universal device for preparation of a watch including a first crown for gain/loss correction and an oscillating resonator arranged to generate an oscillation at a nominal frequency N0, comprising:

means for winding and for correcting the gain/loss of said watch, comprising at least one robotic manipulator for operating said first crown;

an adjustment device, which includes at least one gain/loss correction device for correcting the gain/loss of said watch, which includes a gain/loss-corrector oscillator arranged to generate an oscillation at a correction frequency NC and to subject said watch to an oscillation at said correction frequency NC and/or to a modulated movement, said gain/loss correction device comprising gain/loss control means arranged to control the oscillation of said gain/loss-corrector oscillator and interfaced with gain/loss measuring means comprised in said universal preparation device for measuring the gain/loss of the watch, wherein said gain/loss correction device includes an automatic winder for mechanical or automatic watches, and includes at least one watch-holder stand, which is subjected to the oscillations and/or movements generated by said gain/loss-corrector oscillator.

2. The universal preparation device according to claim 1, wherein said gain/loss control means are also arranged to control an excitation oscillation generated by a master oscillator at an excitation frequency NE, approximately equal to said nominal frequency N0 or to a multiple integer of the nominal frequency N0, said master oscillator having a master variation-in-rate value AM with respect to a reference, which is lower than the initial variation-in-rate value DI of said watch with respect to said reference, and which are interfaced with rate measuring means comprised in said universal preparation device for measuring the variation in rate of said watch.

3. The universal preparation device according to claim 2, wherein said rate measuring means include at least one microphone for evaluating the frequency, rate and amplitude of said oscillating resonator, and, when a variation in rate greater than a predetermined threshold is observed, said gain/loss control means are arranged to control at least one excitation oscillation generated by a master oscillator at said excitation frequency NE to return said variation in rate to an intermediate value between said master value AM and said initial value DI of the variation in rate.

4. The universal preparation device according to claim 2, wherein a same oscillator forms said gain/loss-corrector oscillator and said master oscillator.

5. The universal preparation device according to claim 1, wherein said automatic winder for mechanical or automatic watches is motorized and configured to automatically wind an automatic watch by moving said watch and an oscillating weight of said watch and/or by magnetic driving of the oscillating weight.

6. The universal preparation device according to claim 1, wherein said at least one robotic manipulator is arranged to maneuver a first removable cap tightly gripping said first crown, or to grip a peripheral groove comprised in said first crown.

7. The universal preparation device according to claim 1, wherein said automatic winder includes at least one said robotic manipulator for charging energy storage means comprised in said watch, by maneuvering said first crown or a second crown specifically for winding, or a said first removable cap tightly gripping said first crown, or a second removable cap tightly gripping said second crown.

8. The universal preparation device according to claim 1, wherein said universal preparation device includes a reference clock to which said gain/loss measuring means, which include a vision system, refer, and, when the gain/loss relative to said clock reference is less than one minute, said gain/loss control means are arranged to generate at least one oscillation of gain/loss-corrector oscillator to return the gain/loss of said watch to the value of said reference clock, and, when the gain/loss relative to said reference clock is more than one minute, to cause a robotic manipulator to maneuver said first crown to adjust the gain/loss of said watch.

9. A watch storage arrangement for a watch bank comprising:

the universal preparation device according to claim 1, and at least one watch comprising a time base including at least one oscillating resonator, means of gain/loss correction via a control stem provided with a said first crown, and energy storage means or a barrel, and energy charging means, wherein each said watch of said storage arrangement for a watch bank includes, for automatic adjustment of the gain/loss thereof, a first groove around said first crown and/or a first removable cap arranged to tightly grip said first crown to allow the manipulation thereof in translation and/or rotation by a robotic manipulator.

10. The watch storage arrangement for a watch bank according to claim 9, wherein said energy charging means are formed by an automatic winding mechanism including at least one oscillating weight and/or by a manual winding mechanism using said control stem or a winder comprising a second crown or a pusher.

11. The watch storage arrangement for a watch bank according to claim 10, wherein at least one said watch includes, for the automatic energy charging thereof, a second groove around said second crown and/or a second removable cap arranged to tightly cover said second crown to allow the manipulation thereof in translation and/or rotation by a robotic manipulator.

12. The watch storage arrangement for a watch bank according to claim 9, wherein said energy charging means are formed by an automatic winding mechanism including at least one wheel set inside the case of said watch and arranged to be driven contactlessly by contactless drive means comprised in said automatic winder or said stand, or by a magnetic or electrostatic field.

13. The watch storage arrangement for a watch bank according to claim 9, wherein at least one said watch includes a removable cap for watches, having an internal profile complementary to the external profile of a crown or of an actuator comprised in said watch, said removable cap is articulated and/or elastically deformable between a first presentation position in which said removable cap can be radially or frontally inserted onto a said crown or said actuator, and a second clamping position in which said removable cap is able to grip said crown or said actuator tightly longitudinally and/or radially, and said removable cap includes external gripping means arranged, in said second clamping position thereof, to allow manipulation by a said robotic manipulator in all degrees of freedom.

14. A method for adjusting the gain/loss of said watch of said watch storage arrangement for a watch bank according to claim 9, comprising:

identifying said first removable cap suitable for said first crown of said watch;

pulling said first crown out;

fitting said first crown with said first removable cap;

placing said watch said stand of said universal preparation device;

performing an action on a control means to activate said gain/loss measuring means and to make a measurement of the gain/loss of said watch; and adjusting the gain/loss of said watch by said robotic manipulator controlled by said gain/loss control means.

* * * * *